United States Patent [19]

Gansert et al.

[11] 4,435,033

[45] Mar. 6, 1984

[54] TWO-PART SEPARABLE ELECTRICAL CONNECTION ARRANGEMENT

[75] Inventors: Willi Gansert, Kornwestheim; Gert Jakob, Stuttgart; Lothar Ruttkowski, Ludwigsburg-Ossweil; Siegfried Goetzke, Bietigheim-Bissingen; Kurt Stammler, Schwieberdingen, all of Fed. Rep. of Germany

[73] Assignee: Robert Bosch GmbH, Stuttgart, Fed. Rep. of Germany

[21] Appl. No.: 421,389

[22] Filed: Sep. 22, 1982

Related U.S. Application Data

[63] Continuation of Ser. No. 283,357, Jul. 14, 1981, abandoned.

[30] Foreign Application Priority Data

Aug. 19, 1980 [DE] Fed. Rep. of Germany ..... 3031261

[51] Int. Cl.[3] ..... H01R 13/635

[52] U.S. Cl. ..... 339/45 M; 339/91 R

[58] Field of Search ..... 339/45 R, 45 M, 91 R

[56] References Cited

U.S. PATENT DOCUMENTS

| | | | |
|---|---|---|---|
| 2,760,174 | 8/1956 | Burtt et al. | 339/91 R |
| 2,899,669 | 8/1959 | Johanson | 339/91 R |
| 3,409,858 | 11/1968 | Krehbiel | 339/91 R |
| 3,588,784 | 6/1971 | Kunkle et al. | 339/91 R |
| 4,272,145 | 6/1981 | LaDuke | 339/91 R |

*Primary Examiner*—Joseph H. McGlynn

*Attorney, Agent, or Firm*—Frishauf, Holtz, Goodman & Woodward

[57] ABSTRACT

To permit one-hand operation of engagement and disengagement of separable electrical connectors, for example of multi-terminal connectors in automotive use, the connectors are formed with adjacent side walls fitting within each other; the inner side walls of one part are formed with locking projections extending laterally outwardly and having at least one flat engaging surface extending transversely to unlocking direction, and fitting against a matching engaging surface formed on the side wall of the other part. To permit unlocking, the inner side wall is formed with a projecting fulcrum bead or ridge, the side wall of the other part being extended beyond the fulcrum bead or ridge so that, upon compression of the extending portion over the fulcrum bead or ridge, the side wall of the other part will be resiliently deflected outwardly, thus releasing the engagement surfaces from each other.

6 Claims, 4 Drawing Figures

TWO-PART SEPARABLE ELECTRICAL CONNECTION ARRANGEMENT

This is a continuation, of application Ser. No. 283,357 filed July 14, 1981, now abandoned.

The present invention relates to electrical connectors, and more particularly to a multiple part electrical connector which is especially adapted for mobile applications, where the two parts of the connectors have to be reliably coupled and locked together while permitting release without tools and, preferably by one-hand operation, so that inaccessibly located connections can be reliably joined, or severed, with requiring tools or excessive manipulation.

BACKGROUND

It is known to provide multi-terminal interconnecting arrangements, for example for automotive or other mobile use, in which one of the connecting parts engages the other connecting part by a snap element which snaps over a projection or into a recess on the other part. Many such connectors are used in automotive field; in one type, a connector which is of flat, elongated form, has a projecting locking element riveted thereto, the riveted locking element usually being a spring metal component. Manufacture of such connectors with the additional locking element requires time and components and additional assembly steps. It is frequently difficult to locate the locking spring, particularly when the connector is provided on a cable connector of many wires, since the locking spring may be inaccessible. Thus, in order to sever the two parts of the connecting arrangement, it is often necessary to use two hands because otherwise the spring cannot be depressed or unlocked while, at the same time, pulling one connector part away from the other. Two-hand operation for mere disconnection of an electrical connecting element is frequently very difficult because of inaccessibility of the parts and insufficient space to reach in or under other components beneath the hood of an automotive vehicle or other similar installation.

THE INVENTION

It is an object to provide a separable connector element, particularly adapted for tight spaces, for example for automotive use, in which the two parts can readily be severed, and requiring only one-hand operation while, however, providing for reliable locking-together of the two parts when they are to remain or be connected.

Briefly, the two parts are releasably pivotably connected together at one end portion; the two respective parts are formed with elongated interengaging, interfitting side walls extending tranversely to the end portions, in which one of the side walls extends outside the side walls of the other, and beyond the side walls of the other. The respective side walls are formed with interengaging projection-and-recess means, such as, for example, projecting ridges, bumps or the like, formed on the side walls of the inner one of the two connected elements, and recesses in matching positions formed in the surrounding side walls of the outer connecting element. To permit ready release of the projection from the recesses, the inner element is, additionally, formed with a projecting bead spaced from the projection-and-recess means, the bead forming a fulcrum point about which the outer side wall can be tipped or pivoted, thus spreading away the outer side wall from immediately adjacent position with respect to the side wall of the inner part, and permitting release of the interengaging projection-and-recess means. The pivotable connection which provides for preliminary relative alignment of the parts, can then readily be severed by lifting off the releasable part from the other part, after the interengaging locking fit has been released.

The arrangement has the advantage that all the components needed to permit locking-together of the two parts, and also unlocking or release of the parts from each other, are formed on the parts of the connection elements themselves. Preferably, they are made of molded plastic. The locking components can be located approximately in the center of the longitudinal sides of the connecting elements to permit ready one-hand locking or, also, one-hand unlocking and release of the elements from each other.

In accordance with a preferred feature of the invention, the side walls of one of the elements additionally has formed thereon projecting spring elements which insure vibration-free and shock-free engagement of the electrical components, and prevent loosening of the connection arrangement while, additionally, assisting disconnection after the interengaging locking elements have been released from each other.

DRAWINGS

Figure 1:
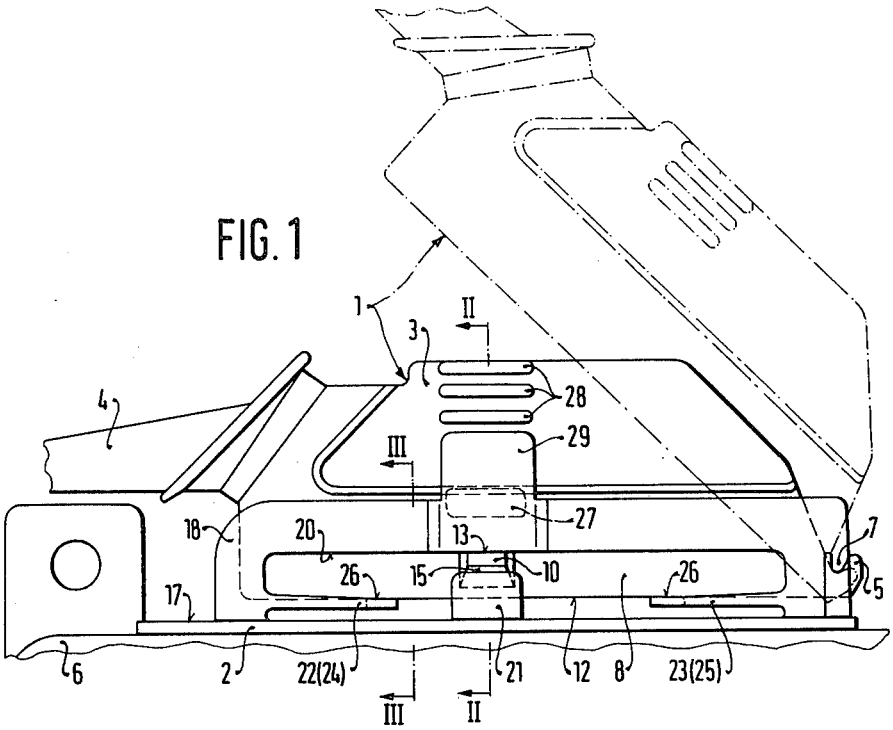
FIG. 1 is a schematic illustrative side view of two connectable parts, in which the full-line position illustrates the parts connected, and the chain-dotted position illustrates the disconnected position of one part with respect to the other.

The interconnection arrangement—see FIG. 1—has a first part or element 1 which is pivotally connected to a second part or element 2. When connected together, the two parts 1, 2 are locked together, as illustrated in the full-line drawing of FIG. 1. The part 1 is made of plastic, and is formed with a grip groove 3, which retains therein in any suitable manner—not shown, and well known in the art, a plurality of electrical contact elements, positioned in one or more rows and located in a contact carrier. An electrical cable 4, containing wires to which the contact carriers, for example small tubular or pin-like elements or the like, are connected, extends from the part 1 which, at the outside, also forms the handle thereof. The side remote from the cable terminal 4 has a hook 5 molded thereto, for engagement with a matching cross pin or cross element 7 projecting from part 2, as will appear. The hand grip groove may be formed with gripping projections 28, preferably positioned at least opposite the interlock, as will appear.

The second part 2 also is made of plastic and is formed as a contact carrier, receiving contact elements which match those in the part 1. The part 2 may, for example, be integral with the cover 6 of an electronic control unit or the like, and the arrangement and positioning of the electrical terminals, and their shape, is determined by the design of the interconnection unit, and may be of any suitable construction. A narrow side or end wall, extending transversely to side walls 18, 19 of the base of part 2 has a projection 7 formed thereon which can be engaged with the hook 5 or a narrow end wall of the part 1 to provide a pivotable connection between the parts 1 and 2 and thus position the parts in alignment with respect to each other prior to locking engagement.

Figure 2:
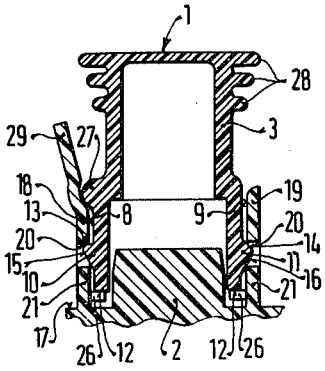
FIG. 2 is a transverse section along line II—II of FIG. 1.
Figure 3:
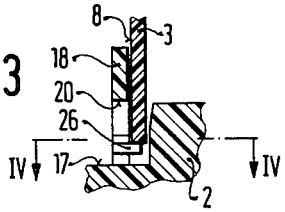
FIG. 3 is a fragmentary transverse section along line III—III of FIG. 1.
Figure 4:
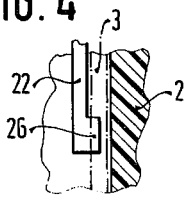
FIG. 4 is a fragmentary transverse section along line IV—IV of FIG. 3.

Parts 1 and 2 are locked together by a locking device. The parts of the locking device are molded on the respective parts 1 and 2, in the region of the gripping groove 3. The longitudinal sides 8, 9 of the part 1, in the region of the gripping groove 3, are formed with laterally projecting engagement projections 10, 11 (see FIG. 2). The projection 10 is formed with a transversely extending engagement surface 13, projecting laterally, for example and preferably at a right angle or at a slightly acute angle from an edge 12 of the gripping groove 3. The engagement projection 11 preferably forms a bump or ridge projecting at an obtuse angle from the corresponding longitudinal side 9 to form a ridge-like engagement surface 14. Both engagement elements 10, 11 are downwardly inclined in the direction of insertion movement, to form inclined surfaces 15, 16 at the edge facing the lowermost portion of the part 2, and merging into the side walls beneath the gripping groove 3.

The second part 2 of the connector has two projecting side walls 18, 19, projecting upwardly from the wall portion 17 of the part 2. The side walls 18, 19 extend around and closely fit next to the side walls 8, 9 of part 1. The side walls 18, 19 are molded on part 2. Side walls 18, 19, at a location opposite the bottom 17 thereof, are formed with recesses or cut-outs having engagement surfaces 20 thereon for the projections 10, 11, projecting from the side walls 8, 9 of the part 1. The recesses or cut-outs are elongated slits. Side walls 18, 19 are resiliently outwardly deflectable. A guide tongue (FIG. 1) extends in the plane of the walls 18, 19 from the side 17 of the base of part 2, molded for example integrally with the remainder of part 2 and projecting upwardly from the side 17 thereof. The hinge formed by hook 5 and projection 7 thus is positioned transversely with respect to the longitudinal side walls 8, 9 of part 1 and 18, 19 of part 2.

Spring arms 22, 23, 24, 25 sides of the wall portions 18, 19, extending perpendicularly to the engagement surfaces 20 (FIG. 1) of the walls 18, 19. The spring arms, in disconnected arrangement, that is, when parts 1 and 2 are disconnected, project slightly upwardly towards the engagement surface 20, and project up to—with clearance—the center guide tongue 21, as best seen in FIG. 1. The end portions of the spring tongues 22–25 are formed with engagement surfaces 26 which face towards the cut-out of engagement surface 20 on the side walls 18, 19.

Operation—engagement of parts 1 and 2:

Part 1 can be hooked into part 2 by interengaging the hook 5 with projection 7—see FIG. 1. This preliminarily connects the parts and can be done with one hand. Part 1 is then pivoted downwardly from the chain-dotted position (FIG. 1) about the hinge axis of hinge 5, 7, transverse to the side walls towards the full-line position. Upon such pivoting, the inclined surfaces of the projections 10, 11 will slightly press outwardly the walls 18, 19 until the projections 10, 11 engage against the engagement surface 20 on the cut-out of the respective side walls 18, 19. The cut-outs or slots in the side walls 18, 19 span the projections 10, 11 and extend on either side thereof. The guide tongues then engage against the inclined insertion surfaces 15, 16. The edge 10 of the gripping groove 3 is pressed against the engagement surface 26 of the respective spring arms 22 to 25. The spring arms 22 to 25 are resiliently deflected, that is, they are under spring loading, and the engagement surface 26 extends at least approximately parallel to the lower surfaces on the side walls 18, 19. The part 1 is reliably retained on the part 2, and vibration, shocks, or other mechanical interference cannot loosen the parts from each other, nor result in any relative movement of the respective parts.

In accordance with the invention, release of the locked elements 1 and 2 is readily effected with one-hand operation by molding the release element directly on the respective parts of the connecting arrangement. A cam element 27 is molded in form of a ridge on the longitudinal side 8 adjacent the gripping groove 3 in the region of the side wall 18 and above the locking or engagement projection 10 i.e. intermediate the depth of side wall 18. The ridge 27, forming a cam, also forms a fulcrum for the side wall 18 which, in the region of the ridge or projection or cam 27 is extended with an extending flap 29. The grooving or ridging 28 formed in the gripping groove 3 preferably extends in alignment with the extension flap 29. Extension flap 29 forms a lever and is in engagement with the cam 27 adjacent its connection to the side wall 18. Its free end, when engaged, extends under an acute angle from the longitudinal side away from the gripping groove 3—see FIG. 2.

Operation—disconnection:

To release the part 1 from part 2, it is necessary to remove the laterally extending engagement surface 13 of the projection 10 from side wall 8 from engagement with the surface 20 on the side wall 18 of part 1. Since these surfaces extend, under engaged position, parallel to each other, for example and preferably at about a right angle with respect to the engagement movement, it is necessary to release either side wall 18 outwardly, or side wall 8 inwardly. In the embodiment shown, the side wall 8 is maintained in specific position by an inner projecting ridge formed on the part 1, around which the side walls 8, 9 project (see FIG. 2), so that, in engaged position, the side walls 8, 9 are positively positioned with respect to part 1. One-hand release can readily be effected by pressing the lever 29 towards the gripping groove 3, whereupon the lever 29 and with it side wall 18 will be tipped about the cam 27, forming a fulcrum, thereby pressing side wall 18 outwardly and releasing engagement of the projection 10 and its engagement surface 13 from the engagement surface 20 of side wall 18 on part 1. The four spring arms 22 to 25, under tension, tend to push or throw outwardly the part 1 with respect to part 2 for at least a predetermined limited distance, thus assisting in release of the engagement projection 11, with its engagement surface 14 forming an obtuse angle with the remainder of the side wall 9, and releasing the projection 11 from engagement surface 20 on the side wall 19. The part 1 then can be readily removed by the same hand of the operator with which release was effected, by pivoting part 1 upwardly—see FIG. 1, chain-dotted position—about the hinge 5, 7 at right angles to the gripping surfaces of part 1, and then severing the hinge connection 5, 7. The gripping ridges 28, or grooves, as desired, increase reliability of operation and provide a tactile indication to the operator where the tongue 29 is located so that it can be tilted inwardly, for release.

Various changes and modifications may be made within the scope of the inventive concept. For example, the engaging surfaces 13, 20 can be formed on both sides, that is, the arrangement illustrated at the left half of FIG. 2 can be duplicated at the right half, so that releasing movement will then require compression of two flaps towards each other.

We claim:

1. A two-part elongated separable electrical connection arrangement comprising a first elongated molded plastic part (1) including two spaced longitudinal first-part sheet-like first side walls (8, 9) molded on said first part;

a second elongated molded plastic part (2) including a base, and two spaced resilient projecting longitudinal second-part second side walls (18, 19) molded on said second part, fitting over said first side walls, whereby said first side walls will form inner side walls of the connection arrangement, and said second side walls will form outer side walls, when the connection arrangement is in connected position;

end walls extending transversely to the side walls, means (5, 7) separably, releasably connecting and locking said parts comprising separable hinge means (5, 7) located transversely to the longitudinal direction of the side walls of said parts at an end portion adjacent the end walls, and separably, pivotally connecting said parts together to provide, upon engagement of the hinge means, a pivotal connection of said first and second parts (1,2) in advance of complete engagement of the parts, while permitting complete separation of said first and second parts about a hinge axis transverse to the longitudinal side walls (8, 9; 18, 19);

interengaging projection-and-recess means (10, 11; 20) formed on said first longitudinal side walls and on the second longitudinal side walls, respectively, at aligned locations remote from said hinge means including a first projection (10) extending outwardly from one of the inner walls of said first part (1) and having a flat engagement surface (13) extending at approximately right angles with respect to engagement, or disengagement movement of said respective parts;

a second projection (11) formed on the other side wall (9) comprising a ridge or bump (11) having obtuse angles with respect to the other side wall of said one part;

an elongated opening in each of the outer walls of the second part having engagement surfaces (20) parallel to the flat engagement surface (13) on said projection, whereby, upon hinging, pivotal movement about said transversely located hinge means (5, 7) and engagement of the first and second parts, with the side wall of the first part within the second part, said projection and said opening will lock said parts together;

an integral unlocking or release means including a release cam or fulcrum projection (27) integral with the inner wall of said first part and located adjacent to, and upwardly—in removing direction of the second part—from the engagement surface (13) formed by the first projection (10) of the interengaging projection-and-recess means and extending outwardly from the inner wall of said first part;

and an integral extension flap (29) formed on the immediately adjacent outer side wall (18) of the second part, extending upwardly and beyond said release cam or fulcrum projection (27) to provide a lever and gripping and operating surface for resilient outward deflection of the region or zone of the outer wall immediately adjacent the release cam or fulcrum upon compression of the outer side wall at a point upwardly from, and remote from the fulcrum projection towards the adjacent inner side wall, resulting in tilting movement of the portion of the outer side wall adjacent the projection with respect to the inner side wall and cause release of the projection-and-recess means and, outward bending of the portion of the outer wall adjacent the flat engagement surface (13) of the first projection releases the engagement of surface (20) in the outer wall from the engagement surface (13) of the projection on the inner wall by outward deflection of the zone of the outer wall adjacent said projection from the inner wall, and permits release of said second part by pivoting about said separable hinge means.

2. Arrangement according to claim 1, wherein said cam or fulcrum projection comprises a ridge or bead (27).

3. Arrangement according to claim 1, wherein said cam or fulcrum projection (27) comprises an elongated molded ridge or bead.

4. Arrangement according to claim 1, wherein said elongated opening in each of the outer walls (18, 19) of said second part (2) comprise elongated cut-outs spanning the projection (10) of said first part (1) and extending at either side thereof.

5. Arrangement according to claim 1, further including spring arms (22–25) formed on the second part and having engagement surfaces (26) positioned beneath the side walls (8, 9) of the first part (1) when the parts are locked in engagement with each other, said spring arms extending within an opening formed in the side walls (18, 19) of said second part;

wherein said second part has a top surface (17) from which said side walls (18, 19) project;

and said spring arms are biased upwardly away from said top surface (17) to urge the first and second parts apart upon release of said projection-and-recess means for pivoting separation of said parts.

6. Arrangement according to claim 5, wherein said cam or fulcrum projection comprises a ridge or bead (27) molded on at least one of the first part or inner side walls (8, 9) of said first part.

* * * * *